US006592052B2

(12) United States Patent
Hokao

(10) Patent No.: US 6,592,052 B2
(45) Date of Patent: Jul. 15, 2003

(54) COMMUTATOR OF MOTOR AND METHOD OF MANUFACTURING THE SAME

(75) Inventor: Takayuki Hokao, Anjo (JP)

(73) Assignee: Denso Corporation, Kariya (JP)

( * ) Notice: Subject to any disclaimer, the term of this patent is extended or adjusted under 35 U.S.C. 154(b) by 51 days.

(21) Appl. No.: 09/871,968

(22) Filed: Jun. 4, 2001

(65) Prior Publication Data

US 2001/0052553 A1 Dec. 20, 2001

(30) Foreign Application Priority Data

Jun. 19, 2000 (JP) ..... 2000-183473

(51) Int. Cl.[7] ..... B05B 1/24

(52) U.S. Cl. ..... 239/135; 239/533.9; 239/533.12; 239/585.1; 123/549

(58) Field of Search ..... 239/135, 136, 239/137, 585.1–585.5, 533.1–533.12; 251/129.21; 137/341; 123/298, 549

(56) References Cited

U.S. PATENT DOCUMENTS 5,040,497 A * 8/1991 Dingle ..... 123/298
5,758,826 A * 6/1998 Nines ..... 239/136
5,915,626 A * 6/1999 Awarzamani et al. ..... 239/135
6,102,303 A * 8/2000 Bright et al. ..... 239/135

FOREIGN PATENT DOCUMENTS

JP 61-72868 4/1986

* cited by examiner

*Primary Examiner*—Michael Mar
*Assistant Examiner*—Dinh Q. Nguyen
(74) *Attorney, Agent, or Firm*—Nixon & Vanderhye P.C.

(57) ABSTRACT

A fuel injection device includes a cylindrical valve housing, a valve needle disposed inside the valve housing and a ceramic heater disposed around the valve housing. The valve housing has a fuel inlet at an end, a first fuel passage, a second fuel passage, a nozzle hole at the other end and a valve seat. The valve needle has a hollow portion connected to the first fuel passage and a plurality of fuel apertures connecting the hollow portion and the second fuel passage, a head portion disposed to be seated on or unseated from the valve seat thereby intermittently injecting fuel through the nozzle hole. The ceramic heater is disposed around the valve housing down stream of the fuel apertures and upstream of the valve seat. Fuel vapor can be discharged upward though the fuel apertures.

9 Claims, 4 Drawing Sheets

COMMUTATOR OF MOTOR AND METHOD OF MANUFACTURING THE SAME

CROSS REFERENCE TO RELATED APPLICATION

The present application is based on and claims priority from Japanese Patent Application 2000-183473 filed Jun. 19, 2000, the contents of which are incorporated herein by reference.

BACKGROUND OF THE INVENTION

1. Field of the Invention

The present invention relates to a fuel injection device for an internal combustion engine.

2. Description of the Related Art

In order to reduce noxious components of engine combustion exhaust gas, it is important to atomize fuel injected from a fuel injection device. For example, fuel is heated and decompressed so as to be evaporated. This is very effective, especially, when an engine is started at a cold temperature.

One of an inexpensive way of heating fuel is to heat a portion around the fuel injection device. However, this necessitates large electric power and is not very effective.

Another way of heating is to put a heating element directly in fuel. This necessitates sealing of electric wires, which is very troublesome.

SUMMARY OF THE INVENTION

Therefore, a main object of the invention is to provide an improved fuel injection device having a highly efficient heating arrangement that does not necessitate sealing of electric wires.

A fuel injection device according to a feature of the invention includes a cylindrical valve housing, a valve needle and a ceramic heater. The valve housing has a fuel inlet at an end, a first fuel passage, a second fuel passage, a valve seat and a nozzle hole at the other end. The valve needle is disposed between the first and second fuel passages inside the valve housing. The valve needle has a hollow portion connected to the first fuel passage and a plurality of fuel apertures connecting the hollow portion and the second fuel passage, a head portion to be seated on or unseated from the valve seat thereby intermittently injecting fuel through the nozzle hole. The ceramic heater is disposed around the valve housing down stream of the plurality of fuel apertures and upstream of the valve seat to directly heat a portion of the valve housing.

The nozzle needle may have a bulging portion opposite the ceramic heater to narrow the cross-section of the second fuel passage, thereby effective by heating fuel to be injected.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
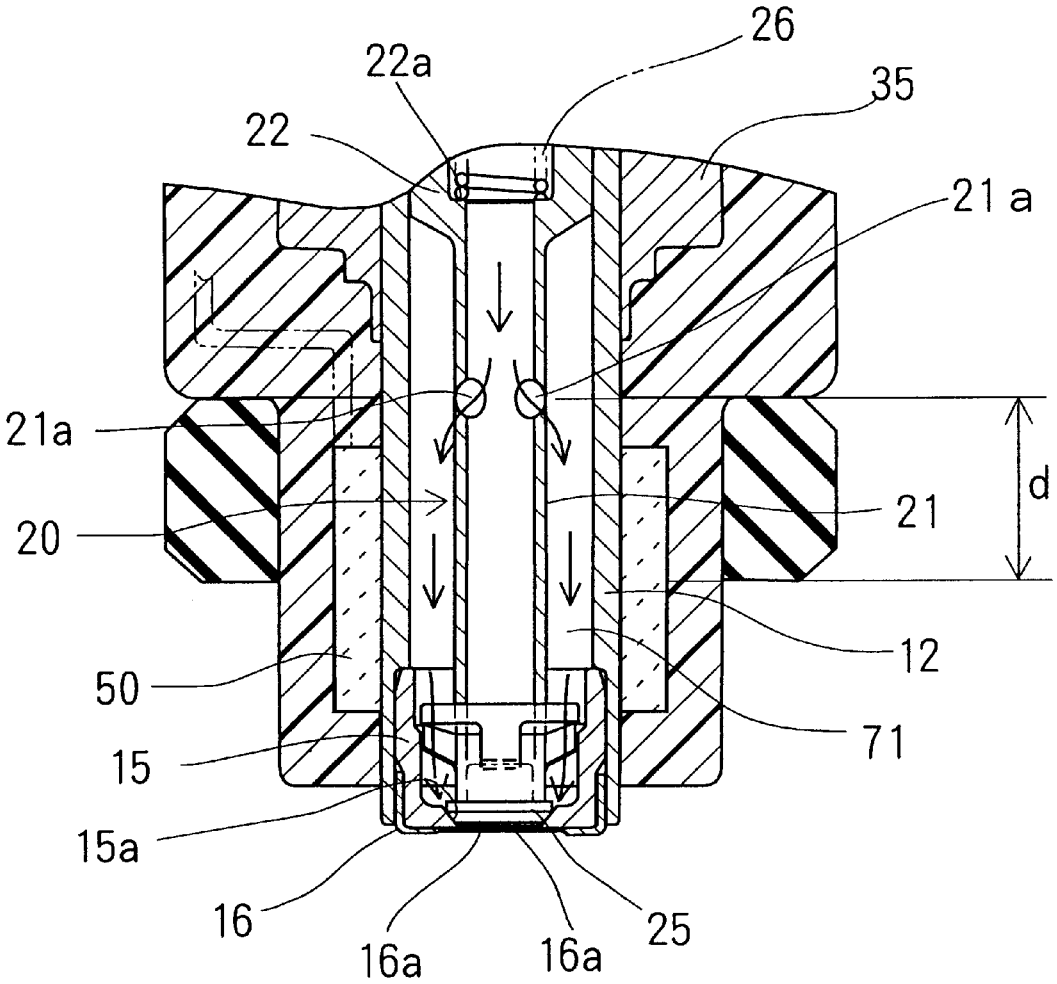
FIG. 1 is a fragmentary cross-sectional view of a fuel injection device according to a first embodiment of the invention.
Figure 2:
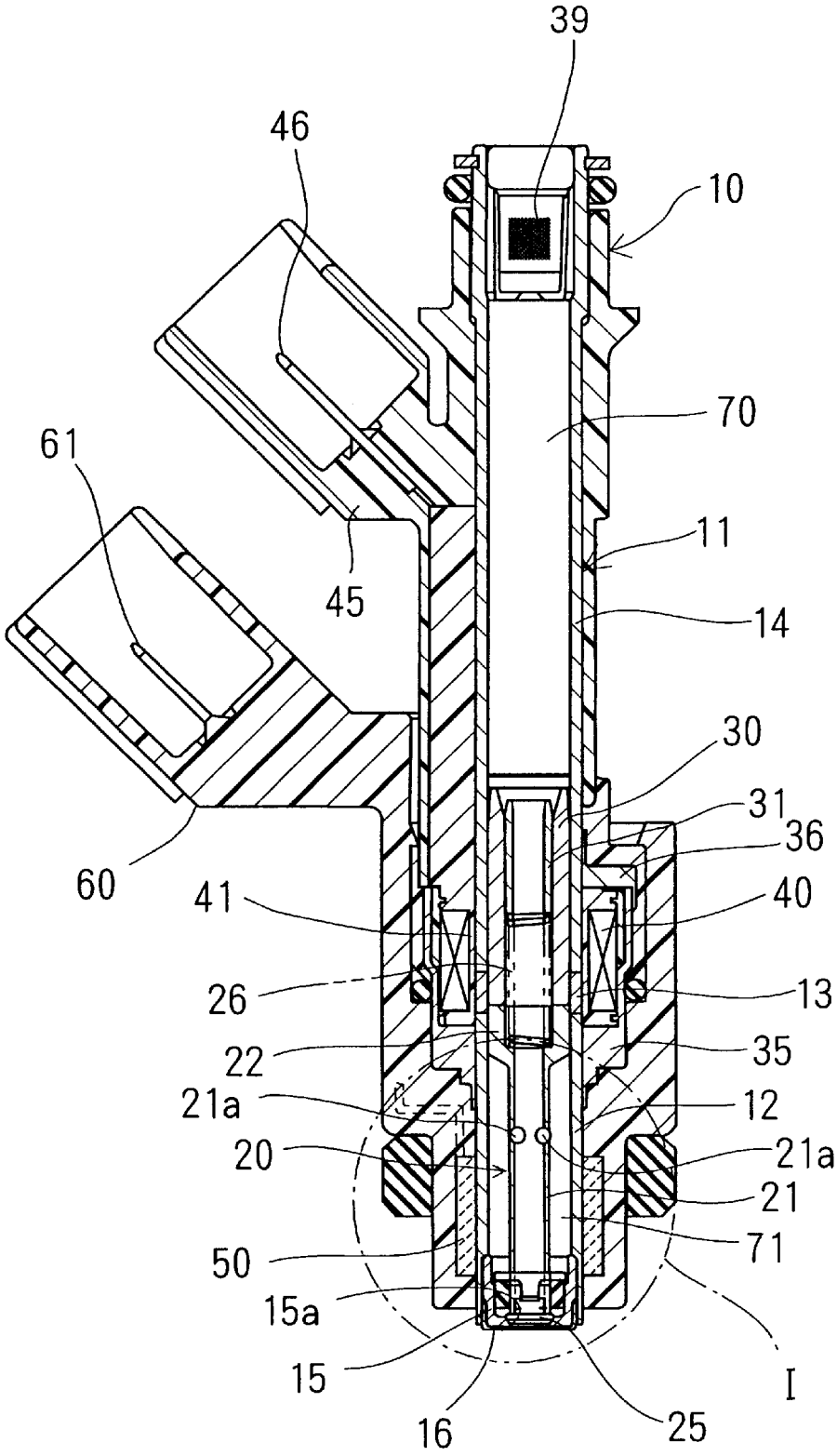
FIG. 2 is a longitudinal cross-sectional view of the fuel injection device according to the first embodiment.

A fuel injection device according to a first embodiment of the invention is described with reference to FIGS. 1 and 2. A hollow cylindrical valve housing 11 is made of a magnetic composite member, which is comprised of a first magnetic portion 12, a non-magnetic portion 13 and a second magnetic portion 14. In the valve housing 11, a valve body 15, a nozzle needle 20, a coil spring 26, a stationary magnetic core 30, an adjusting pipe 31 and a fuel filter 39 are disposed. The nozzle needle 20 divides the inside of the valve housing into a first fuel passage 70 and a second fuel passage 71.

The non-magnetic portion 13, which is formed between the first magnetic portion 11 and second magnetic portion 12 and made of the same material as the others, is heat-treated to become non-magnetic so that the first and second magnetic portions 12 and 14 can be magnetically insulated. The valve body 15 and a cup-shaped nozzle hole plate 16 are disposed inside the first magnetic portion 12.

The nozzle hole plate 16 is made of a thin plate that has a plurality of nozzle holes 16*a* at the center thereof. The nozzle hole plate 16 is fitted and laser-welded to an end of the first magnetic portion 12 to abut the injection surface of the valve body 15.

The nozzle needle 20 has a magnetic hollow cylindrical portion 21 and a non-magnetic head portion 25. The head portion is laser-welded to the cylindrical portion 21 at the end thereof near the nozzle hole plate 16. The cylindrical portion 21 has a thick cylindrical wall 22 disposed opposite the stationary core 30. The head portion 25 is disposed to be seated on a valve seat 15*a* that is formed on the valve body 15. A plurality of fuel apertures 21*a* is formed at a circumference of the cylindrical portion 21 upstream of a ceramic heater 50. The fuel apertures 21*a* may be disposed upstream of the center of the ceramic heater 50. A distance d between the plurality of fuel apertures 21*a* and the longitudinal center of the ceramic heater 50 can be expressed as follows: $0 \leqq d \leqq 20$ mm.

The stationary magnetic core 30 is disposed inside the non-magnetic portion 13 and the second magnetic portion 14 so that the lower end thereof abuts the upper end of thick cylindrical wall 22. An adjusting pipe 31 is force-fitted into the stationary magnetic core 30. The coil spring 26 is supported by the adjusting pipe 31 at an end and by a spring seat 22*a* of the thick wall portion 22 at the other end. The load of the spring 26 is adjusted by changing the depth of the adjusting pipe 31 in the stationary magnetic core 30. The needle 20 is pressed by the coil spring 26 against the valve seat 15*a*.

Magnetic yoke members 35 and 36 are disposed around a coil 40. Yoke member 35 is disposed around the first magnetic portion 12 to be in contact therewith. The yoke member 36 is disposed around the second magnetic portion 14 to be in contact therewith. Thus, the stationary magnetic core 30, the thick wall portion 22, the first and second magnetic portions 12 and 14 and the yoke members 35 and 36 form a magnetic circuit.

The fuel filter 39 is disposed at an upstream portion of the valve housing to remove foreign particles from fuel. The coil 40 is wound around a spool 41 that is fixed to a peripheral portion of the valve housing 11. A resinous mold connector 45 covers the coil 40 and the spool 41. The connector 45 has a terminal 46 embedded in a resinous portion to be connected to the coil 40 at an end thereof and extending from the resinous portion at the other end.

The ceramic heater 50 is a cylindrical member, and the inner periphery thereof is in contact with the outer periphery of the first magnetic portion 12. The ceramic heater 50 is embedded in a resinous connector 60. The connector 60 has a terminal 61 embedded in a resinous portion to be connected to the ceramic heater at an end thereof and extending outward from the resinous portion at the other end.

Fuel is taken into the valve housing 11 through the fuel filter 39. The fuel flows along the first fuel passage 70, a fuel passage in the adjusting pipe 31, a fuel passage in the stationary magnetic core 30 and a hollow portion inside the nozzle needle 20. The fuel flows from the hollow portion through the plurality of fuel apertures 21*a*, along the second fuel passage 71 formed between the cylindrical portion 21 and the first magnetic portion 12. When electric current is supplied to the coil 40, the coil 40 generates magnetic flux which flows along the above described magnetic circuit and generates magnetic pulling force between the stationary magnetic core 30 and the nozzle needle 20. Consequently, the needle 2 is lifted by the coil 40 to unseat the head portion 25 from the valve seat 15*a*. As a result, the fuel is injected from the plurality of nozzle holes 16*a*. When the current supply to the coil 40 is cut, the nozzle needle 20 is pressed by the spring 26 downward and seats the head portion 25 on the valve seat 15*a*.

When an ignition key is turned on to start an engine, electric current is supplied to the ceramic heater 50 for a fixed period. Soon thereafter, the temperature of the ceramic heater 50 rises sharply. When electric current is supplied to the coil 40 to pull up the nozzle needle while the ceramic heater is being operated, the fuel flowing from the plurality of fuel apertures 21*a* comes in contact with the first magnetic portion 12, which is in direct contact with the ceramic heater 50, and is heated. When the heated fuel is injected through the plurality of nozzle holes 16*a,* the fuel is decompressed, evaporated and atomized. This reduces noxious components of the fuel.

Because the plurality of fuel apertures 21*a* are located upstream of the ceramic heater 50, most fuel vapor generated by the ceramic heater 50 is discharged upward through the holes 21*a,* the fuel passage 70 inside the nozzle needle 20. Therefore, the nozzle needle 20 operates at a high response speed.

Figure 3:
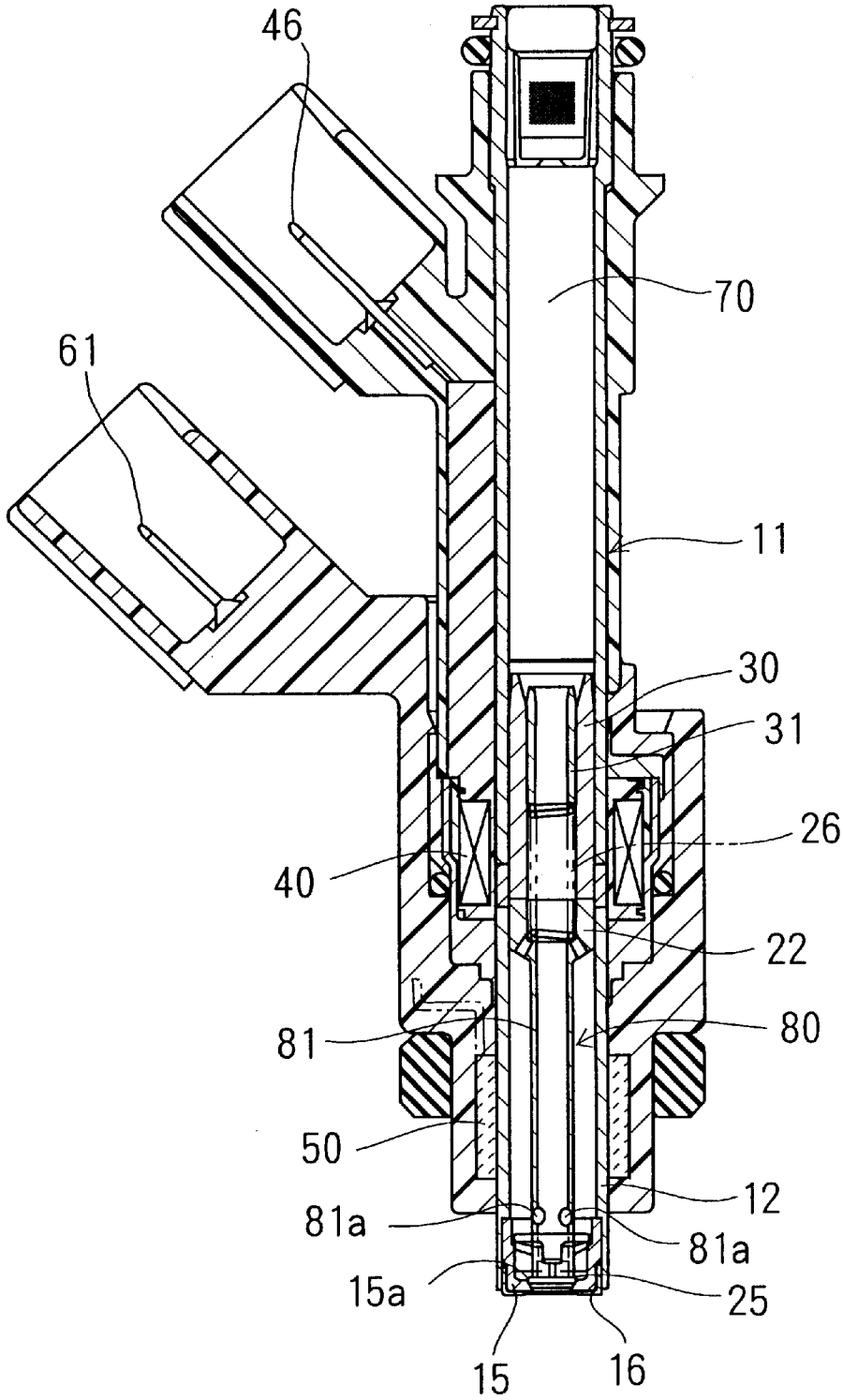
FIG. 3 is a longitudinal cross-sectional view of a variation of the fuel injection device according to the first embodiment.

A variation of the fuel injection device according to the first embodiment is shown in FIG. 3. The variation has a nozzle needle 80 instead of the nozzle needle 20. The nozzle needle 80 has a cylindrical portion 81, which has a plurality of fuel apertures 81*a* down stream of the ceramic heater 50 in stead of the fuel apertures 21*a*. When the nozzle needle 80 is lifted upward, the head portion 25 is unseated from the valve seat 15*a,* fuel flows inside the cylindrical portion 81 remote from the ceramic heater 50. However, the ceramic heater 50 can heat the first magnetic portion 12 to a temperature sufficient to evaporate the injected fuel even if an engine is started at a cold temperature.

Figure 4:
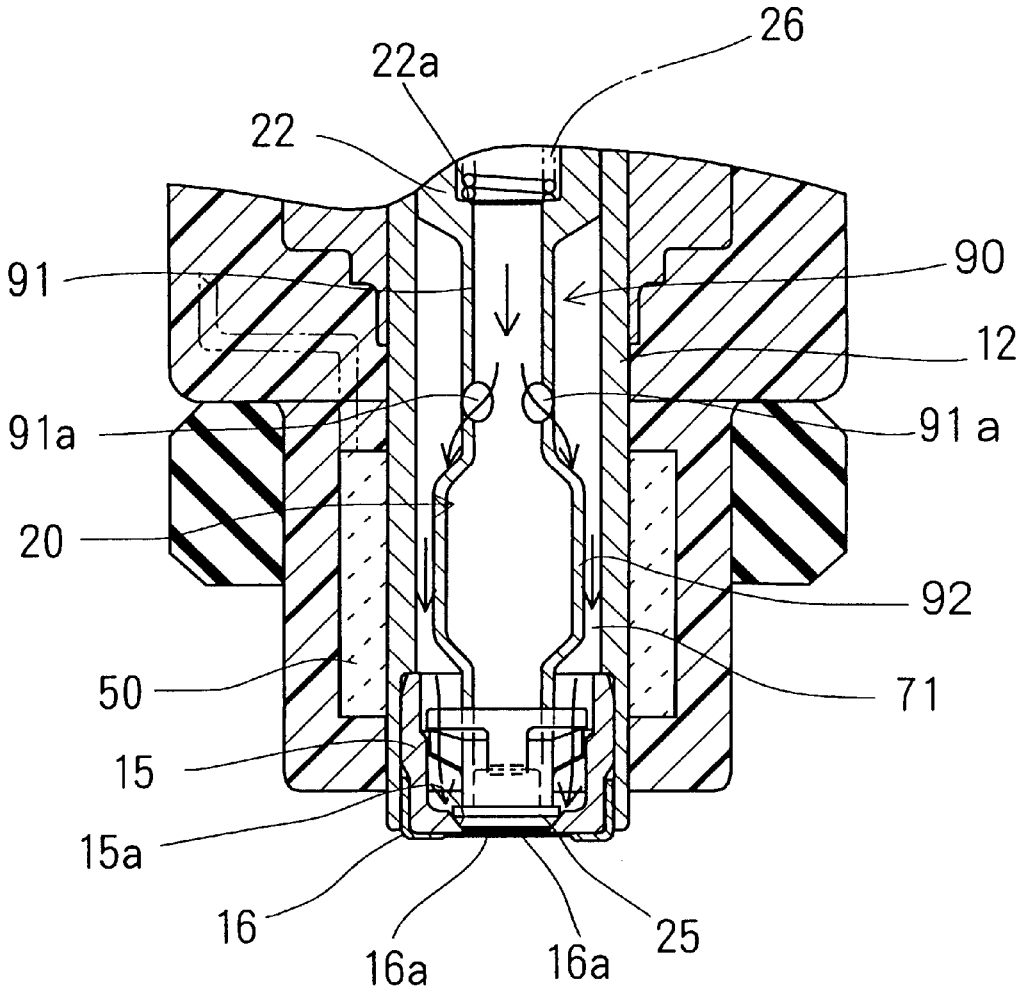
FIG. 4 is a fragmentary cross-sectional view according to a second embodiment of the invention.

A fuel injection device according to a second embodiment of the invention with reference to FIG. 4. In the meantime, the same reference numeral as represented in the preceding figures corresponds to the same or substantially the same portion or component as the first embodiment.

The fuel injection device has a nozzle needle 90 that has a cylindrical portion 91. The cylindrical portion 91 is comprised of a portion having a plurality of fuel apertures 91*a* disposed upstream of the ceramic heater 50 and a bulging portion 92 disposed between the plurality of fuel holes 91*a* and the head portion 25. The fuel passage 71 is narrower in cross-section than the passage 71 of the first embodiment and is wider in cross-section than the gap between the head portion 25 and the valve seat 15*a* when opened. Because of the narrow fuel passage 71, fuel can be heated by the ceramic heater 50 more quickly and effectively. Because the ceramic heater 50 is disposed outside the valve housing 11, it is not necessary to seal lead wires connected to the ceramic heater 50. Because the ceramic heater 50 is covered with resinous material, the terminals, lead wires and the ceramic heater 50 can be jointly supported by the resinous material. Instead of the hollow cylindrical nozzle needle, a solid nozzle needle can be used if fuel passages are formed around the nozzle needle and inside the ceramic heater 50.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense

What is claimed is:

1. A fuel injection device comprising:

a cylindrical valve housing having a fuel inlet at an end thereof, a first fuel passage, a second fuel passage, a nozzle hole at the other end thereof and a valve seat disposed upstream of said nozzle hole;

a valve needle disposed inside said valve housing between said first and second fuel passages, said valve needle having a hollow portion connected to said first fuel passage and plurality of fuel apertures connecting said hollow portion and said second fuel passage, a head portion disposed to be seated on or unseated from said valve seat thereby intermittently injecting fuel through said nozzle hole; and a heater, disposed around said valve housing downstream of said plurality of fuel apertures and upstream of said valve seat, for directly heating a portion of said valve housing;

wherein nozzle needle has a bulging portion disposed opposite said heater to narrow cross-section of said second fuel passage.

2. The fuel injection device as claimed in claim 1 wherein said heater comprises a ceramic heater.

3. The fuel injection device as claimed in claim 1, wherein said heater is covered by resinous material.

4. A fuel injection device comprising:

a cylindrical valve housing having a fuel inlet at an end thereof, a first fuel passage, a second fuel passage, a nozzle hole at the other end thereof and a valve seat disposed upstream of said nozzle hole;

a hollow cylindrical stationary magnetic core;

a hollow valve needle disposed inside said valve housing, said valve needle having a cylindrical magnetic wall member disposed opposite said stationary magnetic core to be magnetically connected to said stationary magnetic core and to be fluid-connected to said first fuel passage, a head portion disposed to be seated on or unseated from said valve seat thereby intermittently injecting fuel through said nozzle hole and a hollow cylindrical needle portion having at least one fuel aperture opened to said second fuel passage between said cylindrical magnetic wall and said head portion, thereby connecting said first fuel passage and said second fuel passage;

wherein said cylindrical needle portion is thinner than said cylindrical wall member; and a heater, disposed around said valve housing downstream of said plurality of fuel apertures and upstream of said valve seat, for directly heating a portion of said valve housing.

5. The fuel injection device as claimed in claim 4, wherein said heater is covered by resinous material.

6. The fuel injection device as claimed in claim 4, wherein said valve housing is made of a magnetic composite member that comprises a first magnetic portion disposed opposite said valve needle, a second magnetic portion disposed opposite said stationary magnetic core, and a non-magnetic portion disposed between said first magnetic portion and said second magnetic portion.

7. A fuel injection device comprising:

a cylindrical valve housing having a fuel inlet at an end thereof, a first fuel passage, a second fuel passage, a nozzle hole at the other end thereof and a valve seat disposed upstream of said nozzle hole;

an electro-magnetic river including a hollow cylindrical stationary magnetic core and a hollow cylindrical magnetic wall disposed opposite said stationary magnetic core to be magnetically connected to said stationary magnetic core;

a hollow needle port on disposed inside said valve housing and connected to said cylindrical magnetic wall, said hollow needle portion being fluid-connected to said first fuel passage via said cylindrical magnetic wall and having a thinner cylindrical wall than said cylindrical magnetic wall, and at least one fuel aperture connecting said first fuel passage and said second fuel passage, a head portion disposed to be seated on or unseated from said valve seat thereby intermittently injecting fuel through said nozzle hole; and a heater, disposed around said second fuel passage downstream of said plurality of fuel apertures and upstream of said valve seat, for directly heating a portion of said valve housing;

wherein said hollow cylindrical magnetic wall is integrated with said hollow needle portion.

8. The fuel injection device as claimed in claim 7, wherein said heater is covered by resinous material.

9. The fuel injection device as claimed in claim 7, wherein said valve housing is made a magnetic composite member that comprises a first magnetic portion disposed opposite said valve needle, a second magnetic portion disposed opposite said stationary magnet core, and a non-magnetic portion disposed between said first magnetic portion and said second magnetic portion.

* * * * *